United States Patent [19]

von Hagen et al.

[11] Patent Number: 4,480,562

[45] Date of Patent: Nov. 6, 1984

[54] SEWING MACHINE LOOP SPREADING MECHANISM

[75] Inventors: Wolf R. von Hagen; Erwin Jürgens, both of Hemmingen, Fed. Rep. of Germany

[73] Assignee: Union Special G.m.b.H., Stuttgart, Fed. Rep. of Germany

[21] Appl. No.: 456,474

[22] Filed: Jan. 7, 1983

[30] Foreign Application Priority Data

Jan. 16, 1982 [DE] Fed. Rep. of Germany ..... 3201254

[51] Int. Cl.[3] ..... D05B 57/02; D05B 61/00

[52] U.S. Cl. ..... 112/200; 112/165; 112/227

[58] Field of Search ..... 112/165, 200

[56] References Cited

U.S. PATENT DOCUMENTS

| | | | |
|---|---|---|---|
| 668,539 | 2/1901 | Onderdonk | 112/200 |
| 961,207 | 6/1910 | Chatfield | 112/165 |
| 1,444,633 | 2/1923 | Moffatt | 112/227 |
| 1,702,792 | 2/1929 | Moffatt | 112/165 |
| 1,825,513 | 9/1931 | Ericsson | 112/200 |
| 1,995,078 | 3/1935 | Rubel | 112/200 X |
| 3,065,717 | 11/1962 | Reimer | 112/165 |

FOREIGN PATENT DOCUMENTS

| | | | |
|---|---|---|---|
| 168767 | 1/1951 | Austria | 112/200 |

*Primary Examiner*—Wm. Carter Reynolds

*Attorney, Agent, or Firm*—John W. Harbst; John A. Schaerli

[57] ABSTRACT

A mechanism for seizing and holding a thread, particularly the looper thread, of a chainstitch sewing machine to insure needle penetration of the thread triangle thereby assuring enchaining of the needle thread with the looper thread. Such mechanism includes an oscillatable thread spreader which transversely moves across the looper's endwise path of travel. The spreader motion being in timed relation with the stitch forming instrumentalities such that its effectively travel extends between the looper eye and the reciprocal path of the needle arranged closest to the looper eye when the looper is at its extreme loop seizing position.

5 Claims, 3 Drawing Figures

SEWING MACHINE LOOP SPREADING MECHANISM

FIELD OF THE INVENTION

The present invention generally relates to chainstitch sewing machines and, more particularly, to a mechanism for spreading and holding the looper thread to insure proper stitch formation.

BACKGROUND OF THE INVENTION

In chainstitch sewing machines, and more particularly those which form chainstitches from three threads, there is frequently a tendency to skip stitches. This is primarily due to the fact that the looper thread loop fails to open sufficiently to permit it to be penetrated by the needle at the appropriate point in the sewing cycle. An attempted solution is to arrange the vertical path of the needle such that the needle shank brushes against the looper blade to assure penetration of the thread triangle. Understandably, however, such a solution has its drawbacks. Fast wearing of the needles, damaging of the needle point and undesirable heat build up are but a few of such drawbacks.

U.S. Pat. Nos. 1,702,792 and 1,825,513 along with German Pat. No. 483,989 are all attempts at a solution of this problem. Such devices, however, involve complex mechanisms which do little to increase the size of the thread triangle at the point and time of needle penetration.

BRIEF DESCRIPTION OF THE PRESENT INVENTION

Because of the above, and in accordance with the present invention, there is provided a loop spreader mechanism which satisfies the needs and wants of the sewing machine trade in a simple and less expensive manner than heretofore known. The loop spreader mechanism of the present invention includes a thread engaging element that is driven from the main shaft of the machine in timed relation with the stitch forming instrumentalities. The thread engaging element of the present invention is arranged for reciprocal and arcuate movement across the endwise path of the looper. The spreader's motion being such that it effectively travels between the looper eye and the reciprocal path of the needle arranged closest to the looper eye while the looper returns from its extreme loop seizing position.

As the spreader moves from its retracted position towards the needle, it engages and distends one limb of the looper thread such that the needle will, with reasonable certainty, pass between the legs or limbs of looper thread on its next penetration of the workpiece. In this manner, the needle may be arranged to more positively pass between the limbs of the looper thread and the looper's body or blade thus avoiding the problems of needle wear, needle point destruction and excessive heat build up. Such benefits are enhanced when dealing with multiple needle machines.

The stringent machine space constraints also provide additional problems. To overcome such constraints, the looper has been especially designed for cooperation with such a loop spreading mechanism. That is, the looper blade is designed to provide close access to the sewing machine throat plate while still allowing for the passage of the loop spreading element in the manner described. One method of accomplishing the desired result is to provide the looper blade with a channel or groove extending transverse thereto and which allows for the free movement of the loop spreading element over the looper blade.

In line with the above, the primary object of this invention is to provide an improved thread loop forming mechanism, particularly for the looper thread, of chainstitch sewing machines.

Another object of this invention is to provide an improved loop spreading mechanism for engaging and distending one limb of looper thread to form with the needle thread loop, arranged about the looper, the usual thread triangle for penetration by the distending needle and forming the succeeding stitch.

Another object of this invention is the provision of a loop spreading mechanism which accomplishes the above objects but yet is simple and relatively inexpensive to construct.

BRIEF DESCRIPTION OF THE DRAWINGS

Having in mind that additional objects and other attendent advantages may well become apparent from an understanding of this disclosure, the invention comprises the devices, combination and arrangement of parts as illustrated in the presently preferred form of the invention which is hereinafter set forth in detail to enable those skilled in the art to readily understand the function, operation, construction and advantages of same when read in conjunction with the accompanying drawings in which.

DETAILED DESCRIPTION OF THE PRESENT INVENTION

Figure 1:
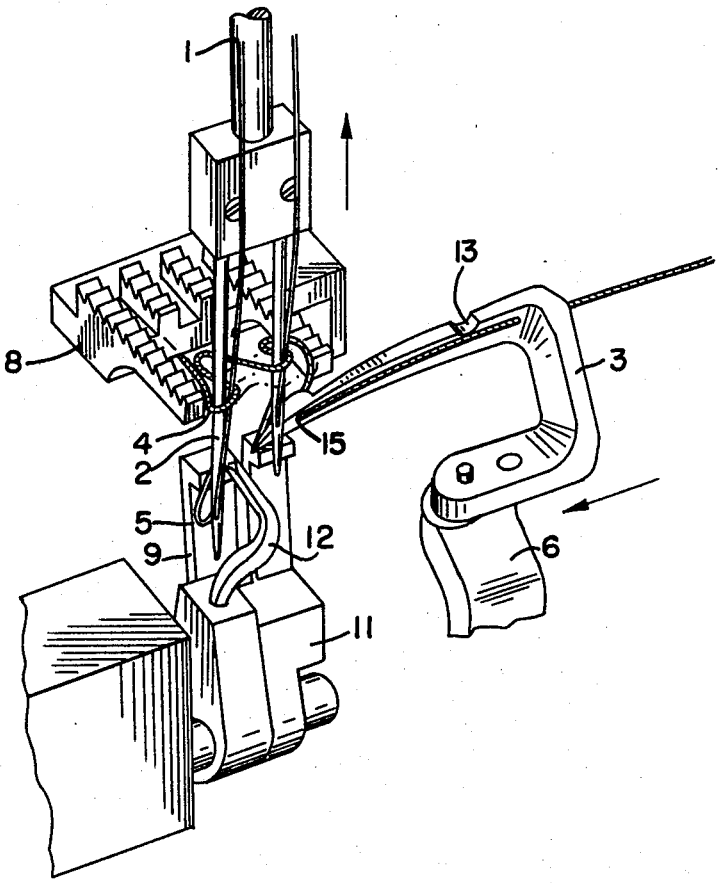
FIG. 1 is a perspective view of the present invention with the stitch forming elements arranged at the beginning of the stitch forming cycle.

Turning now to the drawings, wherein like reference numerals indicate like parts throughout the several views, the invention is illustrated as embodied in a three thread chainstitch sewing machine having a frame only a portion of which is shown. Mounted for generally vertical endwise reciprocation in the machine frame is a needle bar 1. At its distal end, the needle bar carries one or more thread carrying needle means 2. Endwise reciprocation is imparted to the needles through the needle bar in a conventional manner such that the needle means may be reciprocated in a generally linear path of travel. A stitch forming means, represented by a four motion thread carrying looper 3, is mounted in the bed. The looper 3 is formed with a thread eyelet 15 at its distal end and a longitudinal thread accomodating conduit arranged in cooperation with the looper eye. Such looper is adapted to coact with the needles in a conventional manner whereby concatenating the looper thread 4 and needle thread 5 into a series of chain stitches. Also mounted in the machine bed is a work feeding mechanism means represented by a feed dog means 8. In the usual manner, the feed dog cooperates with a presser foot (not shown) to advance a workpiece past the stitch forming instrumentalities of the machine.

In the preferred embodiment, the looper is secured to one end of a looper carrier 6. The other end of carrier 6 is secured to a looper bar. The looper bar is operatively connected to the machine main shaft (not shown) and is adapted to impart an elliptical motion comprised of combined oscillatory and reciprocatory movements to the looper. That is, in addition to the usual endwise loop seizing and endwise loop shedding movements, the looper of this invention is simultaneously moved sidewise in loop spreading movements. During its endwise loop seizing movement, the looper simultaneously moves on one side of the vertical path defined by the reciprocal movement of the needles and then, during the endwise loop shedding movement, the looper moves on the opposite side of the vertical path traced by the endwise reciprocal movement of the needles. Such sidewise movement is commonly referred to as "needle avoid" movements.

To assist in proper stitch formation, a looper thread spreader mechanism is provided to engage and distend one limb of the looper thread loop. Such spreader mechanism assists in forming the usual thread triangle with the previous needle thread loop for entrance or penetration by the descending needles. The looper thread spreader mechanism, as shown in the drawings, comprises a spreader bracket or support 11 and a thread engaging element means 12. While the bracket 11 may be mounted in many ways, it is herein illustrated as arranged on a pivotal shaft which may be rocked about its longitudinal axis by suitable mechanism driven from the machine main shaft such that element means 12 is moved in time relation with the machine operation. According to this invention, such bracket also serves as a support for the needle guard 9. In this manner, the spreader 12 and needle guard 9 may be moved relative to and in synchronized timed relation with the stitch forming instrumentalities by the same movement. Of course, it will be appreciated that a separate drive mechanism may be provided for the loop spreading mechanism of the present invention. With the present arrangement, the spreader element 12 arcuately moves in a direction transverse to the endwise reciprocation of the looper and generally parallel with the direction of feed. The spreader's motion being such that it effectively travels between the looper eye and the reciprocal path of the needle arranged closest to the looper eye during time the looper retracts from its maximum endwise loop seizing position. When the machine is provided with multiple needles, the spreader moves between the needle eye and adjacent the last needle from which a loop is seized by the looper. Preferably, in those machines wherein the looper's loop seizing motion is from left to right, the spreader moves on the left side of the last needle from which a loop is seized by the looper. In those machines wherein the looper's loop seizing motion is from the right to left, the spreader moves on the right side of the last needle from which a loop is seized by the looper.

As a skilled artesian may appreciate, the distance between the throat plate, not shown, and the top of the looper blade should be minimized in operation. To achieve this end, without distracting from the effectiveness of the present invention, the looper has been designed or constructed with a channel or trough shaped groove 13. The channel 13 provides adequate travel clearance for the element 12 over the looper blade or body. The curved configuration of the looper blade extending from the looper tip to the channel being such as to provide adequate clearance for the spreader element's continued advance travel. By this construction, the spreader 12 may move from its retracted position, shown in FIG. 1, toward and over the looper blade to grasp the looper thread 5 within the constricted space constraints of the machine.

In operation, the looper 3 is actuated through a four motion cycle in timed relation to the actuation of the needle. In FIG. 1, the needle, after reaching the lowermost point of its stroke, has begun its ascending stroke and has cast out a thread loop which is just being entered by the beak of the looper 3 during its loop seizing movement. During this part of the stitch forming cycle, the needle guard 9 is arranged in a position adjacent the vertical path of the needles and the spreader does not perform any useful function. During the loop seizing movement of this stitch forming cycle, the looper moves toward the ascending needle and at the same time around one side of the vertical path of the needles in a sidewise advance movement. As the needle is completely withdrawn from the work, the looper which now extends through both loops of the needle thread, continues its endwise movement to the left as seen in the drawings.

The following motion in the stitch forming cycle, which is the loop shedding motion, comprises an endwise sliding movement of the looper towards its initial position. Simultaneously therewith, the looper is giving a sidewise motion which allows the looper to move on the opposite side of the vertical path of needle reciprocation. From FIG. 2 it will be seen that during this part of the cycle, the needle guard is moved away from the path of the needles. Simultaneously therewith, the spreader element 12 crosses over the endwise path of the looper in a path of travel which extends between the eye of the looper and the path of the needle. The spreader initially moves through the groove 13 engaging the looper thread and is prepared to carry one thread in the loop of looper thread further in the direction of workpiece advancement whereby distending the looper thread loop.

Figure 2:
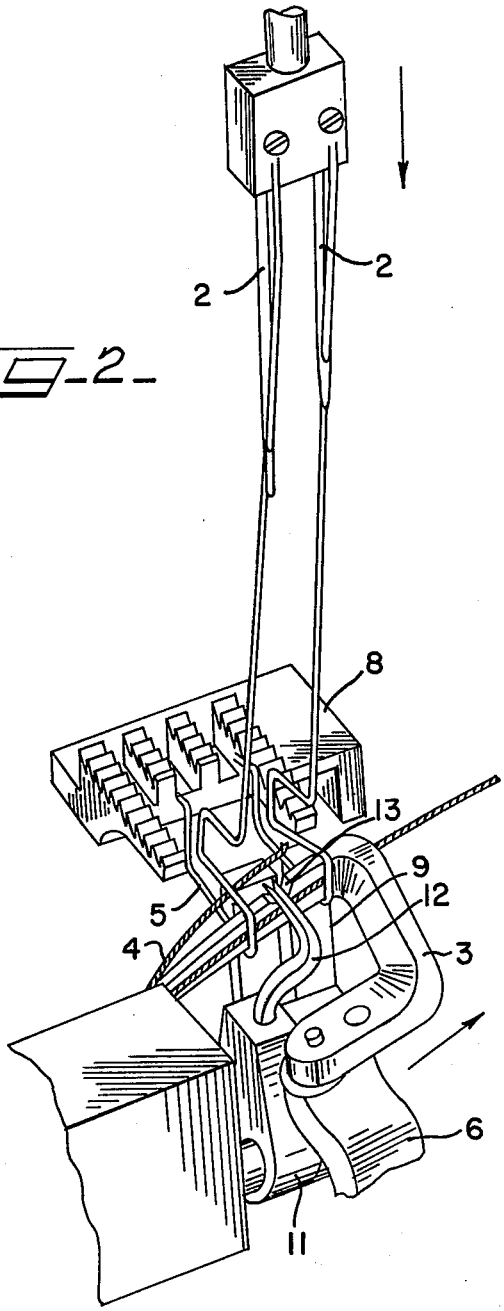
FIG. 2 is a perspective view similar to FIG. 1 illustrating the advance movement of the spreader across and over the looper blade.
Figure 3:
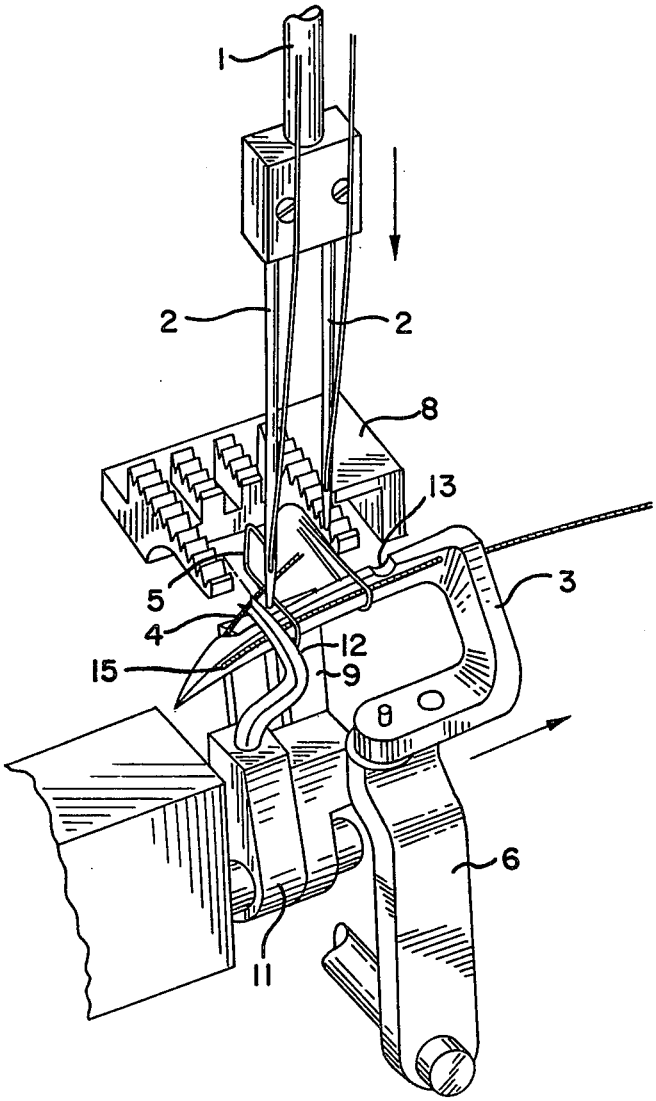
FIG. 3 is a perspective view similar to FIG. 1 shown with needles penetrating the looper thread loop distended by the loop spreading mechanism of the present invention.

As seen in FIG. 2, the limbs of the looper thread loop extend in divergent directions. One limb of thread engaged by the spreader mechanism extends to the last stitch set in the workpiece while the other looper thread limb runs parallel with the looper blade. In such an arrangement, the two legs or limbs of looper thread are pulled out at an acute angle to each other. The needle thread loop that encloses the looper thread loop acts to form a triangle with the two legs of looper thread through which the needle passes on the next penetration. The angle between the thread is widened in advance of the entry therein by needles through the action of the thread spreading mechanism of the present invention. In operation, with the looper at its extreme loop seizing position, the spreader is set to effectively move between the eye of the looper and the needle's path. When the looper reached its foremost sidewise position to the side of and in advance of the needles, the engaging element approaches and spreads the limbs of the looper thread as far apart as possible. As mentioned, understandably the loop spreading mechanism moves across the endwise path of the looper along a path extending adjacent the last needle from which a loop is seized by the looper such that the needles will unerringly enter the spread thread triangle resulting in proper stitch formation.

Thus, there has been provided a Sewing Machine Loop Spreading Mechanism that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

Thus, having adequately described our invention, what we claim is:

1. A sewing machine having a feeding mechanism, a thread carrying looper means including an apertured looper body movable through a four motion cycle of actuation including an endwise loop seizing movement, a sidewise advance movement, an endwise return loop shedding movement and a sidewise return movement, at least one threaded reciprocatory needle means adapted for actuation in timed relation with respect to said looper means through a stitching cycle during which said needle means enter between two limbs of the looper thread in the formation of a chainstitch, a looper thread handling means adapted to spread the limbs of looper thread to form a loop for subsequent penetration by said reciprocal needle means, said thread handling means comprising:

thread spreader means being adapted to advance across the endwise path of the looper means between the aperture provided in the looper body and the reciprocal path of the needle means arranged closest to the aperture in the looper as the looper moves through the simultaneous endwise return loop shedding and sidewise return looper movements from the extended limit of its loop seizing movement, said thread spreader means thereby engaging only the looper thread and spreading only one limb of the looper thread in the direction of feed during its advance movement to permit the needle means to pass between the looper thread and the body of the looper.

2. The invention according to claim 1 wherein said thread engaging spreader means is arranged on a support which oscillates parallel to the direction of feed.

3. The invention according to claim 2 wherein said support also provides the means for driving a needle guard.

4. The invention according to claim 1 wherein said spreader means is adapted to cross over the body of the looper in the path of its travel.

5. The invention according to claim 4 wherein said looper means is channeled to allow for such passage of the spreader means.

* * * * *